United States Patent [19]

Peckham

[11] 4,073,025

[45] Feb. 14, 1978

[54] PORTABLE BRIDGE

[75] Inventor: William T. Peckham, Eugene, Oreg.

[73] Assignee: Hamilton Construction Co., Springfield, Oreg.

[21] Appl. No.: 770,754

[22] Filed: Feb. 22, 1977

[51] Int. Cl.[2] ..... E01D 15/12

[52] U.S. Cl. ..... 14/2.4

[58] Field of Search ..... 14/2.4, 1, 17, 13; 404/1; 52/641, 645

[56] References Cited

U.S. PATENT DOCUMENTS

| | | | |
|---|---|---|---|
| 498,994 | 6/1893 | Strobel | 14/17 |
| 854,329 | 5/1907 | Charron | 14/17 |
| 1,252,873 | 1/1918 | Adams | 14/17 |
| 2,546,676 | 3/1951 | North | 52/645 |
| 2,744,590 | 5/1956 | Butts | 52/645 |
| 2,977,612 | 4/1961 | Frost | 14/2.6 X |
| 3,021,544 | 2/1962 | Gillois | 14/2.6 X |
| 3,438,663 | 4/1969 | Colson | 52/645 X |
| 3,492,683 | 2/1970 | Wagner | 14/2.4 |
| 3,754,293 | 8/1973 | Wagner | 14/1 |
| 3,886,613 | 6/1975 | Busch | 14/14 |

*Primary Examiner*—Nile C. Byers

*Attorney, Agent, or Firm*—Klarquist, Sparkman, Campbell, Leigh, Hall & Whinston

[57] ABSTRACT

A portable bridge structure for carrying trucks and other large vehicles is described including two longitudinal bridge sections which are transported separately to the bridge site and are fastened together after installation by means of pivotable diaphragm members. The pivotable diaphragm members are pivotally attached to one bridge section and after pivoting into position, are bolted to bracing flanges on both sections to fixedly secure the sections together. Each bridge section includes at least one longitudinal support member and a plurality of cross members extending across the top of such support member to provide a support frame of a generally T-shaped cross section. The longitudinal support member may be either a hollow built-up beam member or it may be formed by two I-beams which are joined together by rigid interconnecting members. The portable bridge of the present invention is especially useful on logging roads, and can be releasably mounted for removal at the end of the logging operation.

12 Claims, 8 Drawing Figures

PORTABLE BRIDGE

BACKGROUND OF THE INVENTION

The subject matter of the present invention relates generally to portable bridges that can be transported to the bridge site as two separate longitudinal bridge sections which are joined together at the site. In particular the invention relates to such a portable bridge in which the longitudinal bridge sections are fixedly secured together by pivotable diaphragm members which are bolted in place at both ends after installation of the bridge sections.

The portable bridge of the present invention is especially useful on logging roads and is of heavy duty construction to carry logging trucks and other large heavy equipment vehicles. The bridge is made of different lengths between 30 feet and 80 feet long and provides the bridge roadway 16 feet wide. It is designed to carry loaded log trucks weighing up to 250,000 pounds.

It has previously been suggested to provide portable bridges in the form of two separate longitudinal sections as shown in U.S. Pat. No. 854,329 of Charron. However, this bridge was designed for carrying automobiles and other small vehicles for military use in crossing ditches or trenches, and was only about 10 feet long or short enough to be carried on the side of the automobile during its travel. Such portable bridge employed two longitudinal bridge sections each formed of one piece of sheet metal which is not strong enough for transporting logging trucks and other heavy equipment. Among other things, the prior bridge does not employ a plurality of cross members extending across the top of longitudinal support members to provide each bridge section with a T-shape frame in the manner of the present invention. Furthermore, it does not employ pivoted rectangular diaphragm members for connecting the longitudinal bridge sections together, and whose opposite ends are fixedly secured to the bridge sections to prevent relative movement therebetween. Of course non-portable permanent bridges such as the railroad bridge shown in U.S. Pat. No. 498,994, have been made of heavy duty construction with steel I-beams which are bolted together on opposite sides of wooden cross members. These permanent bridges have employed bridge frame sections of H-shaped cross sections, which are fixed together by diagonal braces riveted to the I-beams and are extremely heavy so they are not portable.

SUMMARY OF THE INVENTION

It is therefore one object of the present invention to provide a portable bridge which is capable of supporting trucks and other heavy equipment.

Another object of the present invention is to provide such a portable bridge which is transported in two separate longitudinal bridge sections that are joined together after installation by rectangular diaphragm members pivotally attached to one of such sections.

A further object of the invention is to provide such a portable bridge or strong but relatively lightweight construction which includes two longitudinal bridge sections having support frames of T-shaped cross section.

An additional object of the invention is to provide such a portable bridge in which the support frames are each formed by a longitudinal support member and a plurality of cross members extending across the top of such support member, such support member being a hollow built-up beam or a pair of interconnected I-beams.

Still another object of the present invention is to provide such a portable bridge in which the pivoted diaphragm members are fixedly attached at their opposite ends to the longitudinal support members to prevent relative movement between the two bridge sections.

A still further object of the present invention is to provide such a portable bridge with lifting bracket means for lifting the bridge sections into place, such lifting bracket means in its retracted position being below the upper surface of the roadway provided on the bridge sections.

DRAWINGS

Other objects and advantages of the present invention will be apparent from the following detailed description of preferred embodiments thereof and from the attached drawings of which:

DESCRIPTION OF PREFERRED EMBODIMENTS

Figure 1:
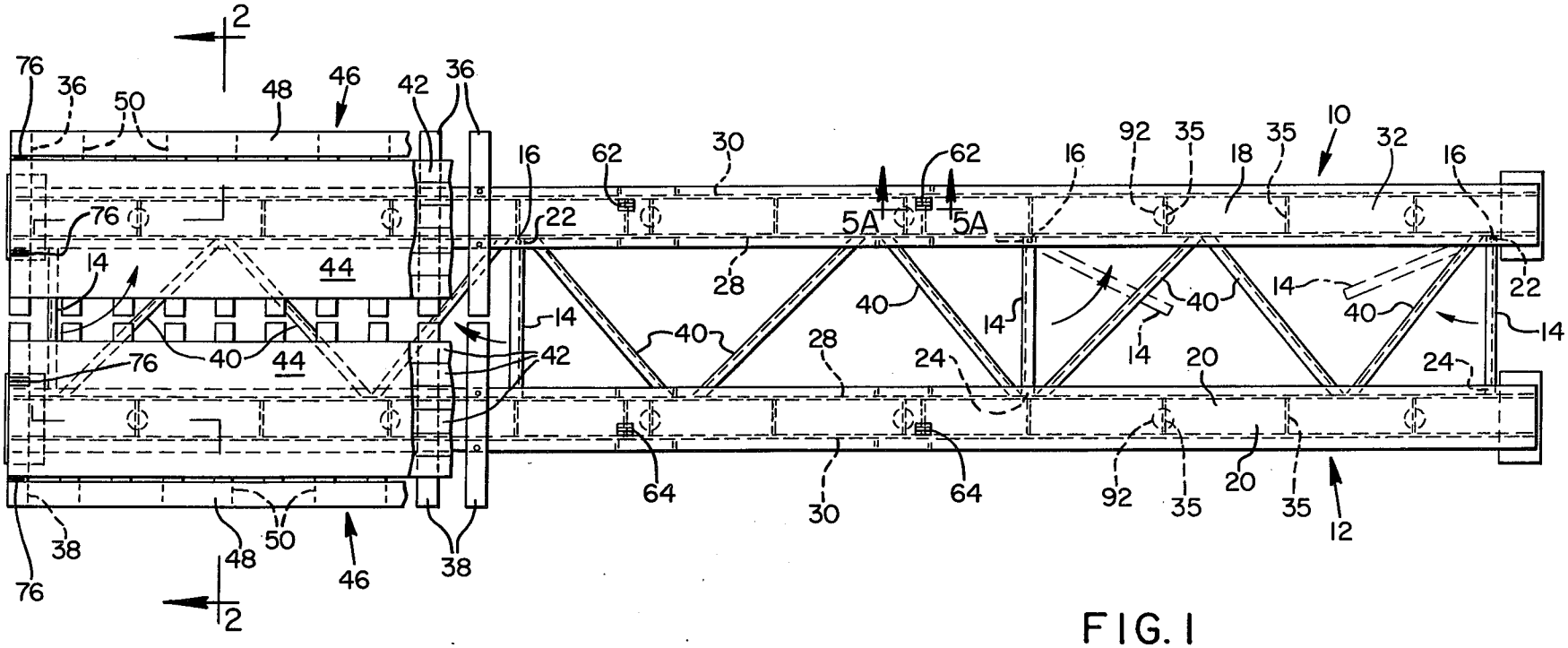
FIG. 1 is a top plan view of one embodiment of the bridge of the present invention with part of the roadway decking and frame cross members removed.
Figures 2, 3, 4, 5A, 5B:
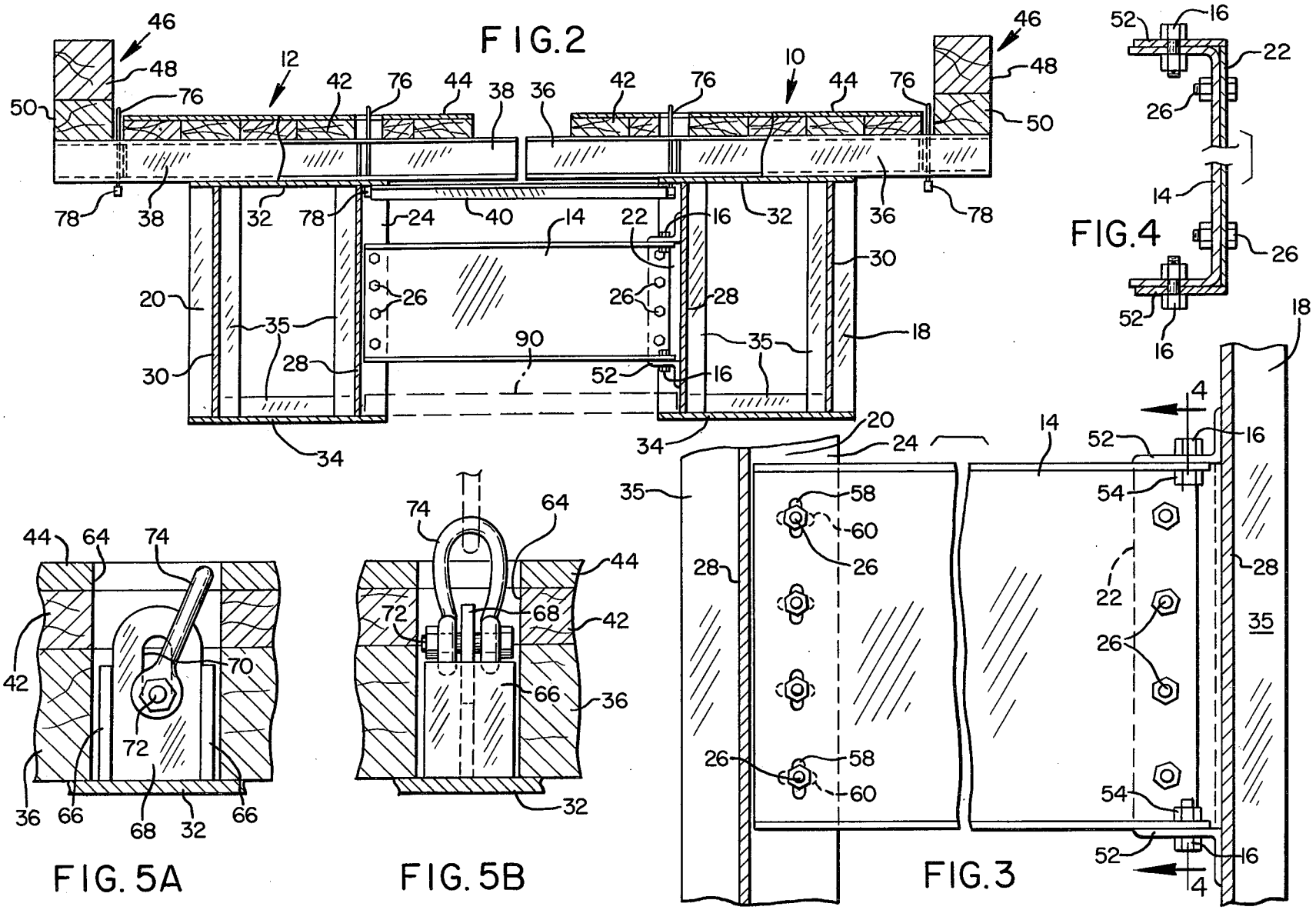
FIG. 2 is a vertical section view taken along the line 2—2 of FIG. 1.
FIG. 3 is an enlarged side elevation view of one of the pivoted diaphragm members in the assembled position of FIG. 2.
FIG. 4 is a vertical section view taken along line 4—4 of FIG. 3.
FIG. 5A is an enlarged horizontal section view of a lifting bracket taken along the line 5A—5A of FIG. 1.
FIG. 5B is a side elevation view of the lifting bracket of FIG. 5A.

As shown in FIGS. 1 and 2, one embodiment of the portable bridge of the present invention includes a pair of longitudinal bridge sections 10 and 12 which are transported by truck to the bridge installation site. The two bridged sections are mounted separately on bridge foundations prepared at the site and are connected together by pivoted diaphragm members 14. The diaphragm members are pivotally member 18 of bridge section 10. After pivoting from a retracted position parallel to support member 18 into the perpendicular position shown, the free ends of the pivoted diaphragm members 14 are releasably secured by bolts to another longitudinal support member 20 of bridge section 12. Thus as shown in FIG. 2, a plurality of vertical bracing flanges 22 and 24 are welded in spaced longitudinal positions to the inside surfaces of the longitudinal support members 18 and 20, respectively. These bracing flanges are arranged in sets of two flanges which are laterally aligned and spaced apart. After installation the pivoted diaphragm member 14 extends between flanges 22 and 24 with the opposite ends of such diaphragm fixedly secured by bolts 26 to such flanges to prevent relative movement between the bridge sections 10 and 12.

In the embodiment of FIGS. 1 and 2, the longitudinal support members 18 and 20 are hollow built-up beam members, each including a pair of vertical side plates 28 and 30, a horizontal head plate 32 and a horizontal base plate 34 welded to the opposite ends of such vertical side plates. A plurality of internal stiffening bars 35 extend up the sides and across the bottom of the interior of the hollow beams 18 and 20 every 10 feet. The base plates 34 provide a flat supporting surface for mounting each of the bridge sections on the bridge foundation. A plurality of cross members 36 extend laterally across the top of the longitudinal support member 18, and are secured to its upper head plate 32 at twenty inch centers longitudinally spaced positions to provide a T-shaped frame for bridge section 10. The two cross members 36 at the opposite ends of the bridge are steel I-beams while the others are 8 × 8 inch wood beams. Similarly, a plurality of other cross members 38 extend laterally across the top of the other longitudinal support member 20 and are fixedly secured to its upper head plate 32 intermediate the ends of such cross members to form a frame of T-shaped cross section for bridge section 12.

As stated previously by bolting both ends of the movable diaphragms 14 to the flanges 22 and 24 on the longitudinal support members 18 and 20, such support members are fixedly secured together to prevent relative movement between such support members. However, for additional strength, diagonal bracing members 40 are bolted between the head plates 32 of the longitudinal support members 18 and 20 in order to more rigidly connect such support members together. It should be noted that the diagonal bracing members 40 extend at approximately 45° angles with respect to the longitudinal support members 18 and 20, while the diaphragm members extend substantially perpendicular to such longitudinal support members.

As shown in FIG. 2, wood decking 42 of 4 × 12 inch boards covered with an upper surface layer 44 of asphalt approximately ½ inch thick, is bolted to the top of each of the cross members 36 and 38. The decking is made in sections approximately 6 feet wide with its inner edges spaced apart approximately 20 inches. In this regard it should be noted that the inside ends of the cross beams 36 and 38 have a clearance of approximately 2 inches. A curb rail 46 is provided at the outside edge of each bridge section spaced outwardly from the decking 42 approximately 2 inches. The curb rail consists of 12 × 12 inch beams 48 mounted on 8 × 12 inch riser members 50 bolted at five foot centers longitudinally spaced positions to the outside ends of the cross members 36 and 38. Thus, the total width of the bridge is 16 feet between the outside edges of the two curb rails, while the width of the roadway between such rails is about 14 feet. The length of the bridge can vary between about 30 feet and 80 feet. Of course, the above dimensions can be changed to accomodate different sized vehicles and are given only by way of example.

As shown in FIGS. 3 and 4, the pivoted diaphragm members 14 are rectangular with a U-shaped vertical cross section. The diaphragm member is mounted on a pair of pivot pins 16 which extend through L-shaped brackets 52 welded to the vertical side plate 28 of the longitudinal support member 18 above and below the diaphragm member. The pivot pins 16 extend through holes in the brackets 52 and holes in the top and bottom edge portions of the U-shaped diaphragm member, such pins being held by nuts 54 threaded onto one end thereof. In the installed position of the diaphragm 14 shown in FIGS. 3 and 4, the opposite ends of the diaphragm member are fixedly attached by bolts 26 to bracing flanges 22 and 24. In this regard two sets of holes 58 and 60 in the left end of the diaphragm member 14 and in the bracing flange 24 are provided. Holes 58 and 60 are elongated in the vertical and horizontal directions, respectively, and intersect one another in the middle of such holes to accomodate some misalignment.

As shown in FIG. 1, two pairs of lifting brackets 62 and 64 may be provided in the middle of the bridge on opposite sides of the center of the bridge sections 10 and 12, respectively. The lifting brackets each include a pair of side plates 66 and a shackle plate 68 welded between such side plates and having an elongated slot 70 through which a clevis bolt 72 extends, attaching a U-shaped clevis member 74 thereto, as shown in FIGS. 5A and 5B. Thus, the clevis bolt 72 slides in the vertical elongated slot 70 to enable the clevis member 74 to move from the retracted position of FIG. 5A to the extended position of FIG. 5B. In the retracted position, the top of the clevis member 74 is recessed below the upper surface of roadway layer 44 of the wood decking 42, while in the extended position it is positioned above such roadway surface to enable it to be engaged by a cable of a lifting crane.

As shown in FIG. 2, each of the bridge sections is also provided with another lifting means in the form of a pair of wire cable loops 76 at the opposite ends thereof. The wire loops are of a general U-shape configuration and are provided with a pair of enlarged stop members 78 clamped onto the opposite ends thereof. The stop members 78 prevent the loops from being pulled out completely through holes in the flanges of the I-beams forming the end cross members 36 and 38 to which such loops are attached as shown in FIG. 2. When the wire loops 76 are not in use they are held in a retracted position below the upper surface of the roadway by the weight of the stop members.

Figure 6:
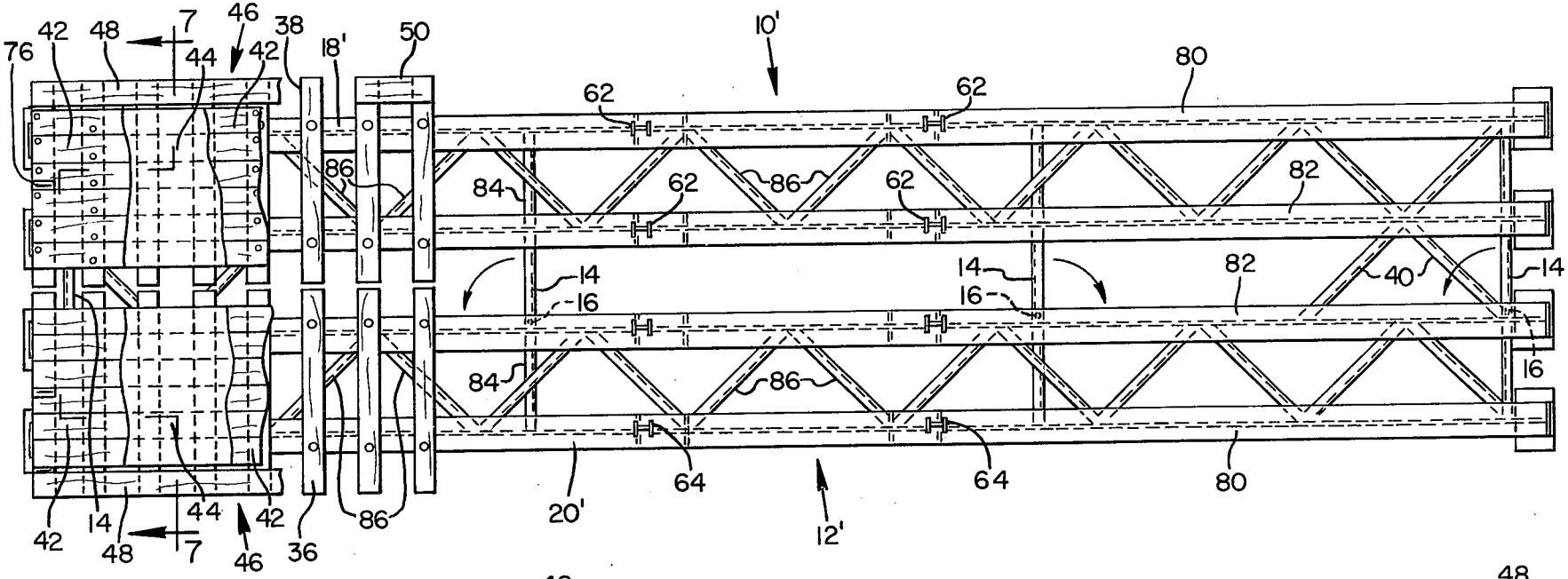
FIG. 6 is a top elevation view of another embodiment of the bridge of the present invention with a portion of the roadway decking and frame cross members removed.
Figure 7:
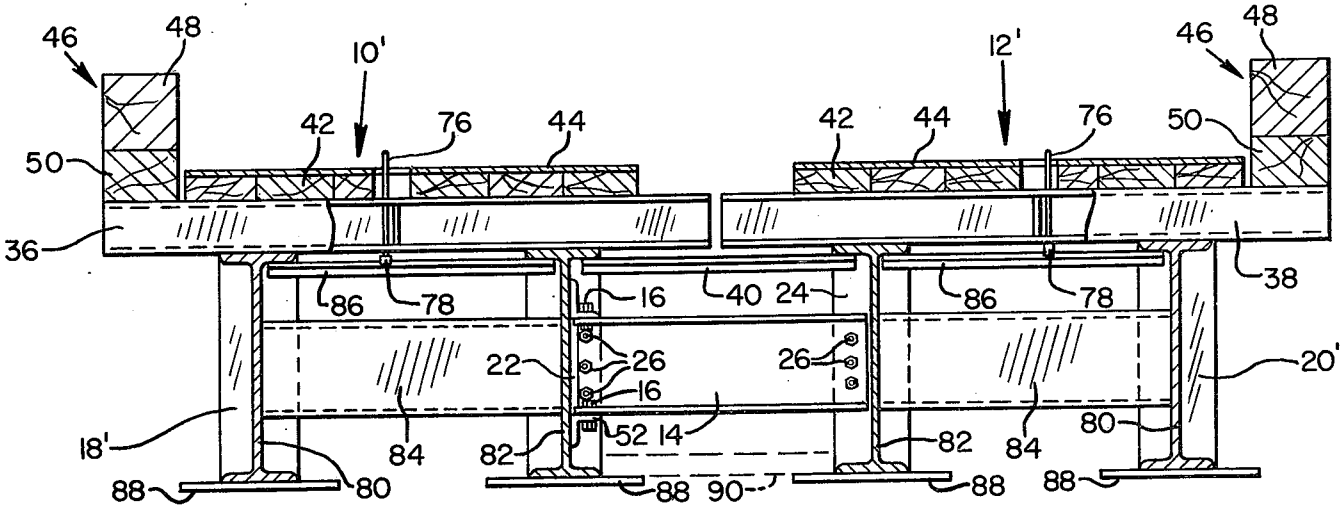
FIG. 7 is a vertical section view taken along the line 7—7 of FIG. 6.

Another embodiment of the present invention is shown in FIGS. 6 and 7. Since this embodiment is similar to that described previously, the same reference numerals will be used to designate like parts, and only the differences between the two embodiments will be described.

The primary difference in the portable bridge of FIGS. 6 and 7 is that the longitudinal support members 18' and 20' are not of the hollow, built-up beam construction of FIGS. 1 and 2. Instead each of such longitudinal support members is formed of two I-beams including an outer I-beam 80 and an inner I-beam 82. The two I-beams are joined together by welded diaphragms 84 of substantially the same size and shape as the pivoted diaphragms 14. In addition the two I-beams 80 and 82 are secured together at the top by diagonal bracing members 86 welded between the top flanges of such I-beams. The cross members 36 and 38 extend across the top of both I-beams 80 and 82 of each of longitudinal support members 18' and 20' to provide two bridge section support frames which are generally T-shaped in cross section.

Bearing plates 88 are welded to the bottoms of the I-beams 80 and 82 to increase the bearing surface area of the bridge sections for mounting on the bridge foundations. The pivoted diaphragms 14 are mounted in a similar manner to that of FIG. 2, except that they pivot on longitudinal support member 20', not member 18'. Thus, the pivot pins 16 extend through mounting brackets 52 which are attached to the vertical intermediate portion of inner I-beam 82 of longitudinal support member 20'. Similarly, bracing flange 22 to which the pivoted end of the diaphragm is bolted is attached to the inner I-beam 82 of longitudinal support member 20', while bracing flange 24 is attached to the inner I-beam 82 of longitudinal support member 18'. Other than these differences, the portable bridge of FIGS. 6 and 7 is similar to that of FIGS. 1 and 2.

As shown in FIGS. 2 and 7, a removable work platform 90 shown in phantom lines can be provided between the inner edges of horizontal base plates 34 of the hollow support members 18 and 20 or between the bearing plates 88 of support members 18' and 20'. The work platform supports a workman while he is fastening the bolts 26, fixedly securing the pivoted diaphragms to bracing flanges 22 and 24, and fastening other bolts securing the diagonal bracing members 40 in place. Thus, there is a 20 inch space between the inside edges of the two decks 42 on the bridge sections 10 and 12 to enable a workman to pass between such bridge sections and between the cross members 36. This enables such workman to set up the platform 90 and to sit on such platform while fastening such bolts.

In addition the hollow built-up beams 18 and 20 of FIG. 1 are provided with inspection holes 92 in the base plates 34 every ten feet for condensed water drainage and to enable visual inspection of the interior of the beams for rust, cracked welds, etc.

It will be obvious to those having ordinary skill in the art that many changes may be made in the details of the above-described preferred embodiment of the present invention without departing from the spirit of the invention. Therefore, the scope of the present invention should only be determined by the following claims.

I claim:

1. A portable bridge structure comprising:

two longitudinal bridge sections adapted for supporting heavy trucks and for releasable mounting in parallel spaced apart relationship in position to span an area to be covered;

each bridge section comprising at least one upright elongated support member extending longitudinally of the bridge, a plurality of cross members extending across the top of said support member so that said support member is positioned intermediate the ends of said cross members and a bridge roadway portion provided on said cross members, said two bridge sections providing two separate roadway portions spaced apart when mounted at said area;

a plurality of rectangular diaphragm members spaced longitudinally along the support members and each pivoted at one end portion to one support member of one bridge section so that the free end portion may pivot toward and be releasably secured to the other support member of the second bridge section to join the bridge sections together when said bridge sections are mounted; and releasable connection means for releasably securing said diaphragm members to said other support member to enable the bridge sections to be separated and transported from said area to another bridge site.

2. A bridge structure in accordance with claim 1 in which the two bridge sections each have a support frame which is of a generally T-shaped cross section formed by said support member and said cross members, and the diaphragm members being connected by pivot pins to said one support member.

3. A bridge structure according to claim 1 wherein each said support member includes a plurality of vertical bracing flanges, said bracing flanges projecting outwardly from one support member toward the other support member to form sets of laterally spaced apart bracing flanges when said bridge sections are mounted; and fastening means for fastening the free end portion of each of said diaphragm members in contact with one bracing flange of a set, and for fastening the pivoted end portion of said diaphram in contact with the other bracing flange of the set so that both end portions and their contacting bracing flanges are fixedly secured together when said bridge sections are mounted to prevent relative movement of the bridge sections.

4. A bridge structure according to claim 3 wherein when said bracing flanges and said diaphragm members are in contact, a plurality of holes through each bracing flange of a set are in substantial alignment with a corresponding plurality of holes in both end portions of the contacting diaphragm member, and releasable fasteners are inserted through the aligned holes to secure the contacting end portions and bracing flanges together.

5. A bridge structure according to claim 4 wherein said diaphragm members each comprise a vertical side plate and a pair of parallel spaced apart horizontal leg flanges, said leg flanges projecting horizontally outwardly from the upper and lower edges of said side plate to provide the diaphragm members with a generally U-shaped cross section, said structure including pivot pin means for pivoting said leg flanges to said one support member.

6. A bridge structure according to claim 1 wherein said bridge sections each have roadway means mounted to said cross member means to provide a roadway surface upon which vehicles may travel, said roadway means including wood decking and a curb rail on the outside edge of the roadway surface.

7. A bridge structure in accordance with claim 6 in which the wood decking is made in two sections attached to the two bridge sections and spaced apart sufficiently to enable a workman to pass therebetween.

8. A bridge structure according to claim 1 in which the bridge sections also include lifting bracket means for connection to a load lifting apparatus so that the apparatus may lift and move the section, said lifting bracket means comprising a plurality of shackle means mounted to said support member at least one of which is positioned on each side of the center of the support member, said shackle means being recessed below the surface of a roadway means provided on the bridge section, and a clevis means attached to each of said shackle means for sliding movement to a first position above and to a second position recessed below the surface of said roadway means, whereby said clevis means may be pulled to said first position to facilitate the connection of the lifting bracket means to the load lifting apparatus and pushed to the other position below the surface of said roadway means when not in use.

9. A bridge structure according to claim 1 which includes lifting means comprising at least two wire loop means one positioned generally at each end of said support members, each wire loop means comprising a piece of wire cable having its ends passing downwardly through bores in a cross member and a retaining clamp with a diameter greater than the diameter of the bores fastened to each end of the cable to prevent the upward removal of the cable.

10. A bridge structure according to claim 1 wherein the support member of each bridge section comprises a pair of elongate generally parallel rigidly interconnected upright I-beams.

11. A bridge structure according to claim 1 wherein each support member includes on the bottom thereof a base plate having a base edge portion projecting outwardly away from the side of said support member adjacent the diaphragms, whereby when said sections are mounted, a work platform may be supported at its ends by the base edge portions to support a workman.

12. A bridge structure according to claim 1 wherein each of said support members are hollow and comprise a pair of vertical side plates, a horizontal head plate for rigidly interconnecting the upper edges of the side plates and a horizontal base plate for rigidly interconnecting the lower edges of the side plates, said head plate providing a flat supporting surface for said cross members and said base plate providing a flat supporting surface for the bridge section.

* * * * *

UNITED STATES PATENT OFFICE

CERTIFICATE OF CORRECTION

Patent No. 4,073,025 Dated February 14, 1978

Inventor(s) WILLIAM T. PECKHAM

It is certified that error appears in the above-identified patent and that said Letters Patent are hereby corrected as shown below:

Column 1, line 60, "or" should be --of--.

Column 2, line 50, after "pivotally" insert --mounted by pivots 16 at one end to a longitudinal support--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*